US009248565B1

(12) United States Patent
Latham

(10) Patent No.: US 9,248,565 B1
(45) Date of Patent: Feb. 2, 2016

(54) METHOD AND APPARATUS FOR SECURING A TAPE MEASURE

(71) Applicant: Jesse M. Latham, Coffeeville, AL (US)

(72) Inventor: Jesse M. Latham, Coffeeville, AL (US)

( * ) Notice: Subject to any disclaimer, the term of this patent is extended or adjusted under 35 U.S.C. 154(b) by 0 days.

(21) Appl. No.: 14/717,078

(22) Filed: May 20, 2015

(51) Int. Cl.
*A45F 5/02* (2006.01)
*B25H 3/00* (2006.01)
*A45F 5/00* (2006.01)

(52) U.S. Cl.
CPC ..... *B25H 3/006* (2013.01); *A45F 5/021* (2013.01); *A45F 2005/006* (2013.01)

(58) Field of Classification Search
CPC ..... A45F 2200/0575; A45F 5/021; A45F 2005/006
USPC ..... 224/162, 904, 269, 242, 267
See application file for complete search history.

(56) References Cited

U.S. PATENT DOCUMENTS

| | | | | |
|---|---|---|---|---|
| 5,388,741 | A * | 2/1995 | Hillinger | A45F 5/02 206/349 |
| 5,544,794 | A * | 8/1996 | Nichols | F41C 33/045 224/198 |
| 8,322,586 | B2 | 12/2012 | Davis | |
| 8,403,132 | B2 | 3/2013 | Moreau et al. | |
| 8,683,710 | B2 | 4/2014 | Johns | |
| 2012/0168472 | A1 | 7/2012 | Mathews | |
| 2013/0181019 | A1 | 7/2013 | Salentine et al. | |
| 2014/0310969 | A1 | 10/2014 | Moreau et al. | |

* cited by examiner

*Primary Examiner* — Corey Skurdal
(74) *Attorney, Agent, or Firm* — George L Williamson

(57) ABSTRACT

Method and apparatus for a tape measure secured within a formfit holster wherein the holster is attached to the belt of a user and a lanyard connects the tape measure to the housing, so as to prevent the tape measure from being dropped by the user while the tape measure is being used. The holster is formfit to the tape measure so as to tightly hold the tape measure therein by frictionally holding the tape measure therein. The lanyard has one end attached a portion of the holster and a second end attached to a portion of the tape measure wherein the lanyard may also have a coiled portion so as to make the lanyard as short as possible.

6 Claims, 2 Drawing Sheets

METHOD AND APPARATUS FOR SECURING A TAPE MEASURE

BACKGROUND OF THE INVENTION

1. Field of the Invention

The present invention relates generally to tool accessories and, more particularly, is concerned with a tape measure secured to a belt holster using a lanyard.

2. Description of the Related Art

Devices relevant to the present invention have been described in the related art, however, none of the related art devices disclose the unique features of the present invention.

In U.S. Pat. No. 8,322,586 dated Dec. 4, 2012, Davis disclosed a holster and belt assembly for a box cutter. In U.S. Pat. No. 8,683,710 dated Apr. 1, 2014, Johns disclosed a tape measure tool with lanyard. In U.S. Pat. No. 8,403,132 dated Mar. 26, 2013, Moreau, et al., disclosed a retractable tooling apparatus and tool pouch. In U.S. Patent Application Publication U.S. 2012/0168472 dated Jul. 5, 2012, Mathews disclosed a drop prevention tool holster. In U.S. Patent Application Publication U.S. 2013/0181019 dated Jul. 18, 2013, Salentine, et al., disclosed a pouch or holster coupled with a retracting device. In U.S. Patent Application Publication U.S. 2014/0310969 dated Oct. 23, 2014, Moreau, et al., disclosed a tape measure holder.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a tape measure secured within a formfit holster wherein the holster is attached to the belt of a user and a lanyard connects the tape measure to the housing so as to prevent the tape measure from being dropped by the user while the tape measure is being used. The holster is formfit to the tape measure so as to tightly hold the tape measure therein by frictionally holding the tape measure therein. The lanyard has a first end attached a portion of the holster and a second end attached to a portion of the tape measure wherein the lanyard may also have a coiled portion so as to make the lanyard as short as possible. The holster is supplied with belt loops so that the user's belt can be passed through the loops so as to tightly secure the holster onto the belt of the user. Also, the belt loops may be replaced with clips as the user chooses.

An object of the present invention is to provide a holster for a tape measure wherein the tape measure is connected to the holster by a lanyard so as to prevent the tape measure from being dropped by a user while in use. A further object of the present invention is to allow a user to work above other workers without the possibility of dropping the tape measure onto the head of the workers below so as to prevent accidents on job sites. A further object of the present invention is to provide a tape measure holder which can be easily operated by the user. A further object of the present invention is to provide a tape measure holder which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 2:
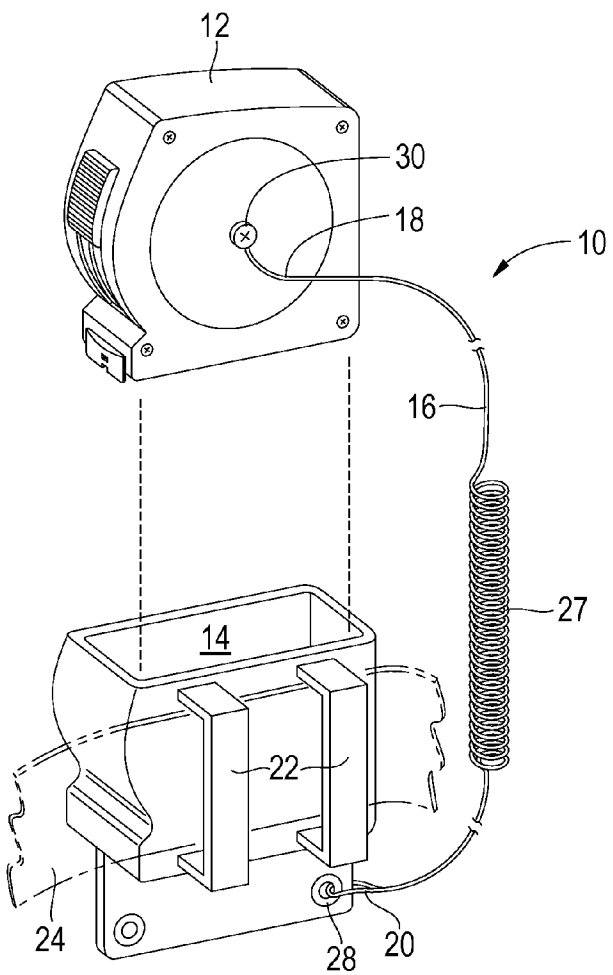
FIG. 2 is a rear exploded perspective view of the present invention shown in operative connection.

With regard to reference numerals used, the following numbering is used throughout the drawings.

10 present invention
12 tape measure
14 holster
16 lanyard
18 first end of lanyard
20 second end of lanyard
22 belt loop
24 belt
26 user
27 coiled portion
28 grommet/rivet
30 fastener
32 object
34 right hand
36 end of tape
38 tape
40 left hand

DETAILED DESCRIPTION OF THE PREFERRED EMBODIMENT

Figure 1:
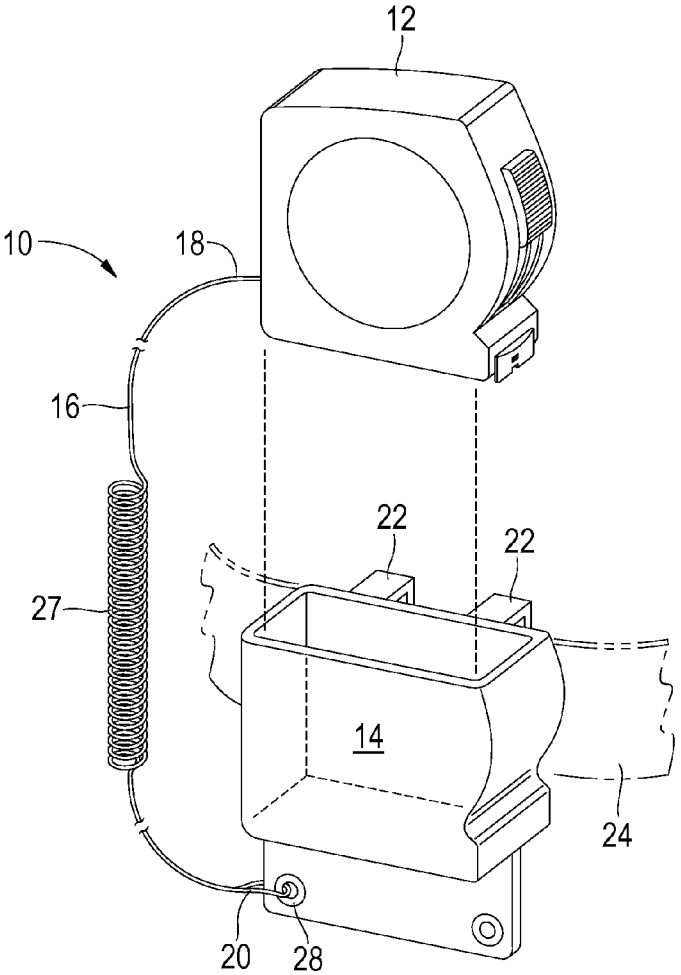
FIG. 1 is a front exploded perspective view of the present invention shown in operative connection.
Figure 3:
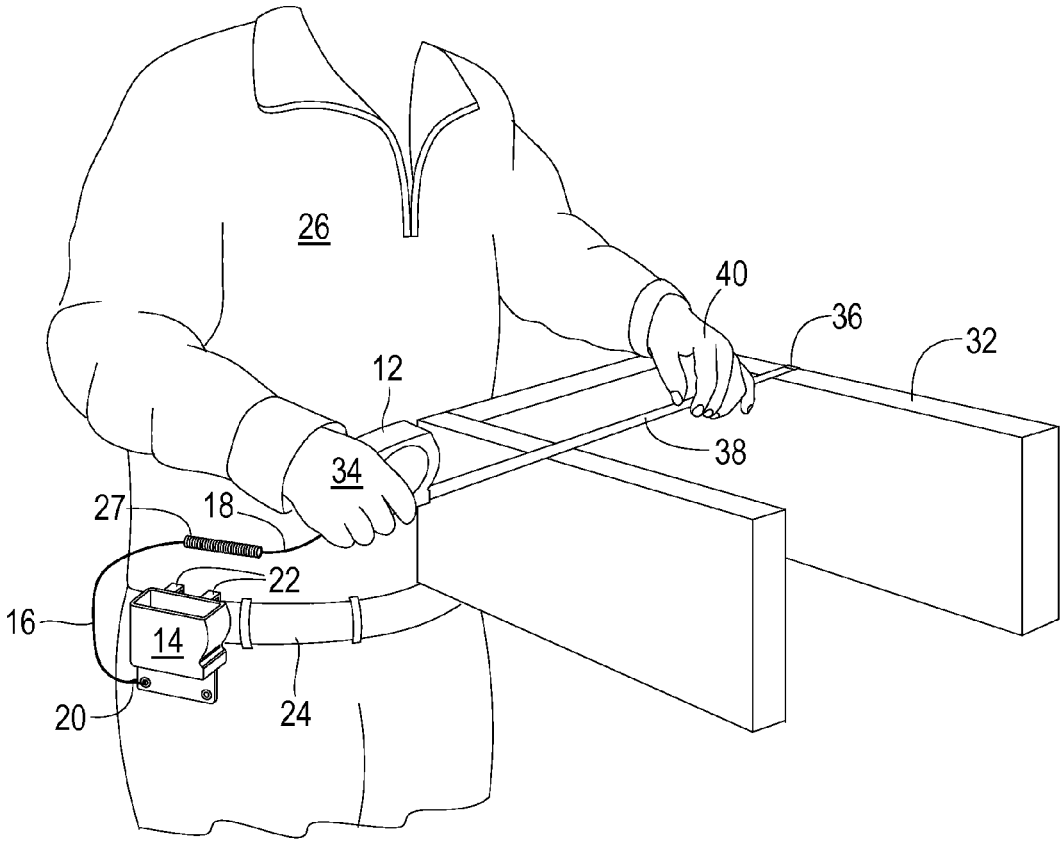
FIG. 3 is a perspective view of the present invention shown in operative connection.

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 3 illustrate the present invention wherein a method and apparatus for holding a tape measure securely to a holster is disclosed and which is generally indicated by reference number 10.

Turning to FIGS. 1 and 2, therein is shown the present invention 10 including a tape measure 12 which can be removably inserted into a formfit holster 14 wherein a lanyard 16 has one end 18 connected to the tape measure and a second end 20 connected to the holster wherein the holster has first and second belt loops 22 which can be placed onto the belt 24 of a user 26 being worn around the waist of a user. The lanyard 16 may also have a portion of it which is coiled 27 as would be done in the standard manner by one skilled in the art. The holster 14 is formfit to the tape measure 12, so that the tape measure is tightly frictionally held inside the holster. Grommets 28 or the like are also provided on the holster as would be done in the standard manner by one skilled in the art so that the second end of the lanyard 20 can be passed through the grommet so as to tightly, securely connect the second end of the lanyard 16 to the holster 14. One end of the lanyard 18 is also shown connected to the tape measure 12 using a fastener 30 or the like, e.g., a screw, on one side of the tape measure so as to tightly secure the lanyard 16 to the tape measure 12. Also the loops 22 for receiving the belt 24 of a user 26 may also be replaced with belt clips as the user selects. Note that the tape measure 12 is inserted into said holster 14 through an opening on a top of the tape measure and that the tape measure is closed on all other sides so as to tightly frictionally secure the tape measure therein and that the grommets 28 are placed in a downwardly extending portion of the tape measure which portion extends downwardly from the bottom of the holster.

Turning to FIG. 3, therein is shown an exemplary view of the present invention 10 in use while measuring the length of an object 32 and includes a tape measure 12 which can be removably inserted into a formfit holster 14 wherein a lanyard 16 has one end 18 connected to the tape measure and a second end 20 connected to the holster wherein the holster has first and second belt loops 22 which can be placed onto the belt 24 of a user 26 being worn around the waist of a user. The tape measure 12 is being held in the right hand 34 of the user 26 and the end 36 of the tape 38 is being held in the left hand 40 of the user as would be done in the conventional manner as the user is about to measure the length of an object 32 which is a wooden object in this example. It can be seen that the tape measure 12 is secured to the holster 14 by the lanyard 16 during the actual measuring process so as to prevent the tape measure from falling away from the user 26 and possibly injuring a worker positioned below the user.

The formfit holster 14 of the present invention 10 is expected to be manufactured from KYDEX or BOLTARON or other similar products which would allow the holster to be custom formfit to the shape and configuration of the tape measure 12. KYDEX is a type of acrylic-polyvinyl chloride material which is suitable for thermoforming fabrication. BOLTARON is also suitable for thermoforming fabrication.

I claim:

1. An apparatus for and in combination with a tape measure for securing said tape measure to a user, comprising:

a) a holster for receiving the tape measure therein;

b) wherein said holster is formfit conforming to a shape and configuration of said tape measure, having a top opening to receive said tape measure, said holster being closed on all other sides for tightly holding the tape measure so as to frictionally secure the tape measure in said holster, wherein the tape measure can be inserted into and removed from said holster through said top opening;

c) wherein said holster has a rear wall with a pair of spaced rectangular shaped belt loops for receiving a belt worn around a waist of the user;

d) a lanyard having first and second ends, wherein said first end of said lanyard is adapted for connection to a side of said holster and said second end of said lanyard is adapted for connection to the tape measure;

e) said lanyard having a coiled portion separated from both the first and second ends thereof by substantial portions thereof;

f) said tape measure having a screw fastener on said side thereof in a central location of said side attached to said second end of said lanyard;

g) said holster having a rectangular shaped wall extending perpendicularly from a bottom thereof with a grommet located at each of distal corners of said rectangular shaped wall; and, h) said first end of said lanyard looped through one of said grommets.

2. The apparatus of claim 1, wherein said holster is made of acrylic polyvinyl chloride material so as to be formfit to the tape measure.

3. The apparatus of claim 2, wherein said holster is made using thermoforming fabrication so as to be formfit to the tape measure.

4. A method for securing a tape measure to a user, comprising the steps of:

a) providing a holster for receiving the tape measure therein;

b) formatting the holster to a shape and configuration of said tape measure, said holster having a top opening to receive said tape measure, said holster being closed on all other sides for tightly holding the tape measure to frictionally secure the tape measure in the holster, wherein the tape measure can be inserted into and removed from the holster;

c) adapting the holster to be secured to a belt worn around a waist of the user by providing a rear wall of said holster with a pair of spaced rectangular shaped belt loops for receiving said belt;

d) providing a lanyard having first and second ends, adapting the first end of the lanyard for connection to the holster and adapting the second end of the lanyard for connection to a side of the tape measure;

e) providing said lanyard with a coiled portion separated from both the first and second ends thereof by substantial portions thereof;

f) providing said tape measure with a screw fastener on said side thereof in a central location of said side attached to said second end of said lanyard;

g) providing said holster with a rectangular shaped wall extending perpendicularly from a bottom thereof with a grommet located at each of distal corners of said rectangular shaped wall; and h) looping said first end of said lanyard through one of said grommets.

5. The method of claim 4, further comprising the step of making the holster of acrylic polyvinyl chloride material for being formfit to the tape measure.

6. The method of claim 5, further comprising the step of thermoforming the holster for being formfit to the tape measure.

* * * * *